United States Patent [19]

Jessup et al.

[11] Patent Number: 4,564,030

[45] Date of Patent: Jan. 14, 1986

[54] CIGARETTE FILTER ASSEMBLY

[75] Inventors: Terry D. Jessup; Albert B. Hudson, both of Greensboro, N.C.

[73] Assignee: Loew's Theatres, Inc., New York, N.Y.

[21] Appl. No.: 398,962

[22] Filed: Jul. 16, 1982

[51] Int. Cl.[4] ..... A24D 3/04

[52] U.S. Cl. ..... 131/336; 131/361

[58] Field of Search ..... 131/336, 331, 361

[56] References Cited

U.S. PATENT DOCUMENTS

| | | | |
|---|---|---|---|
| 2,819,720 | 1/1958 | Burbig | 131/336 |
| 3,396,733 | 8/1968 | Allseits et al. | 131/336 |
| 3,409,020 | 11/1968 | Westbrook et al. | 131/332 |
| 3,590,825 | 7/1971 | Davis | 131/336 |
| 3,605,756 | 9/1971 | Stewart | 131/336 |
| 3,635,226 | 1/1972 | Horsewell | 131/336 |
| 3,759,268 | 9/1973 | Plourde | 131/336 |
| 3,789,855 | 2/1974 | Norman | 131/336 |
| 3,800,805 | 4/1974 | Horsewell et al. | 131/336 |
| 3,882,877 | 5/1975 | Brackman | 131/336 |
| 4,266,561 | 5/1981 | Litzinger | 131/336 |
| 4,273,141 | 6/1981 | Van Tilburg | 131/336 |
| 4,460,001 | 7/1984 | Browne | 131/336 |

FOREIGN PATENT DOCUMENTS

| | | | |
|---|---|---|---|
| 0891728 | 7/1982 | Belgium | 131/336 |
| 1400278 | 7/1975 | United Kingdom | 131/336 |

*Primary Examiner*—V. Millin

*Attorney, Agent, or Firm*—Brumbaugh, Graves, Donohue & Raymond

[57] ABSTRACT

A cigarette filter assembly has a filter plug and an open mixing chamber arranged between the filter plug and the distal end of the filter assembly. Perforations are formed in the filter assembly wrapper to communicate between the mixing chamber and outside air, for the purpose of drawing in diluting air to mix with the filtered smoke in the mixing chamber. The filter assembly is constructed to pass smoke and diluting air substantially unimpeded from the mixing chamber to the distal end.

8 Claims, 3 Drawing Figures

CIGARETTE FILTER ASSEMBLY

BACKGROUND OF THE INVENTION

The present invention is an improved tobacco smoke filter of the ventilated type which enhances the taste characteristics of the filtered smoke over known ventilation filters.

A ventilated filter may be defined as a filter which is constructed in a manner such that outside air is drawn into the filter for admission, with the tobacco smoke, to the smoker's mouth, in effect diluting the smoke fraction. The ventilated filter makes it possible to use a higher density filtering medium for removal of greater quantities of smoke while not reducing the draw that the smoker expects.

It is well known that the particular method of air dilution affects the taste characteristics of the product. Modifications of an existing filter construction, to vary the manner in which the diluting air is added to the smoke, can have either a positive or a negative effect on the taste. This is demonstrated by the fact that there are a number of known filter designs exhibiting a variety of porous or perforated filter wrap constructions, combined with one of various types of porous or perforated tipping papers, to obtain desirable dilution systems.

In present day cigarette filters, the perforations for admitting diluting air into the smoke mainstream are located over some portion of the filter section, so as to draw air into the filter. Due to the fact that the outside air is drawn in through the filter periphery, it must follow a tortuous route through the filter wrap and filtering material, toward the core of the filter plug, before encountering the smoke mainstream. Rather than flowing into the center of the filter, the diluting air tends to channel along the filter perimeter resulting in an inefficient mixing of air and smoke. The perimetrical air flow pattern also compresses the smoke stream to the core of the filter. As a result, only a portion of the cross-sectional area of the filter is utilized to filter smoke, reducing the filter efficiency.

U.S. Pat. No. 3,490,461 to Osmalov et al. and U.S. Pat. No. 4,256,122 to Johnson illustrate another type of ventilation-type filter. Channels extending along the length of the filter provide a passage for outside air to be drawn, together with the smoke, into the smoker's mouth. Unlike the ventilated filter constructions described above, the filter wrap is impervious and prevents any mixing of the air stream and the smoke stream until such time as the two streams enter the smoker's mouth. The fact that the air and smoke remain separated affects the taste characteristic of the product. Also, the proper functioning of such a design is dependent upon the channels remaining open while the product is being smoked and on the air stream having free access to the mouth. If either of these two factors are changed, there can be a drastic change in the air-to-smoke ratio.

U.S. Pat. No. 3,496,945 to Tomkin discloses yet another construction of a ventilated filter, which employs a flow-restricting plate to maintain a constant air-to-smoke ratio throughout the smoking cycle. Outside air is drawn into the filter assembly, either into a filter plug, or into a chamber, located upstream of the flow-restricting plate, for mixing with the smoke. The air and smoke mixture is drawn through a restrictive flow orifice in the plate and thereafter either through a second filter or directly out through an open end of the mouthpiece.

The Tomkin construction, introducing air upstream of a flow restricting plate, is intended to regulate the flow pattern of the smoke through the filter plug and the flow pattern of the incoming dilution air so as to control the ratio of smoke-to-air. The fact that mixed smoke and air are drawn through the plate orifice will affect the taste characteristics of the product, as well as increasing the draw resistance of the cigarette. The presence of the flow-restricting plate, having only a small orifice for passing the combined flow streams, may also affect the uniformity of flow of the smoke, upstream of the plate, through the filter plug and thus the filtering performance thereof.

SUMMARY OF THE INVENTION

The present invention is a cigarette filter of the ventilated type exhibiting improved taste characteristics.

More particularly, a filter assembly in accordance with the invention includes a filter plug, which is in end-to-end relation to the tobacco body and a wrapper portion which is at least substantially non-porous and which surrounds and directly engages the filter plug. The wrapper portion preferably includes a combiner wrapper and tipping paper. The filter plug is spaced a distance from the distal end of the wrapper portion.

The filter assembly includes an open mixing chamber which is disposed between the filter plug and the distal end. The wrapper portion has a plurality of perforations arranged to communicate between the chamber and outside air for the purpose of admitting diluting air into the chamber to mix with the mainstream smoke. The filter assembly is constructed so that the smoke and diluting air, after mixing in the mixing chamber, are passed substantially unimpeded from the mixing chamber to the distal end.

In one embodiment of the invention, an open flow tube, for example an extruded plastic mouthpiece for providing radial support at the tip of the filter, extends from the distal end partially into the filter assembly, such that the open mixing chamber is disposed between the mouthpiece and the filter mass. The mouthpiece has one or more longitudinal channels communicating between the mixing chamber and the distal end of the filter assembly so as to offer little or no resistance to flow.

In another embodiment of the invention, the space between the filter mass and the distal end is completely open, forming the open mixing chamber. In a third embodiment of the invention, a secondary filter element extends from the distal end toward the mixing chamber; however, the secondary filter element has a low density so as to offer only a minimal flow resistance, as compared with the resistance of the main filter mass, to the flow of smoke and diluting air from the open mixing chamber to the distal end.

In a cigarette having the novel filter construction of the present invention, the diluting air does not have to penetrate various porous wraps or penetrate the filtering material prior to mixing with the smoke stream. Direct access is provided into the mixing chamber, where the air and smoke commingle effectively prior to the mixture entering the smoker's mouth. As a result, the product exhibits significantly improved taste characteristics.

As opposed to prior constructions described above, the present invention avoids airstream channeling and smoke stream compression and thereby ensures that the full cross-section of the filter is utilized. The integrity of the dilution system is maintained throughout the smoking process, inasmuch as the inlet for the diluting air and the filter path of the smoke stream are less likely to clog or be blocked. A thorough mixing of the air stream and smoke stream occurs prior to the two streams entering the smoker's mouth.

In an exemplary construction, the wrapper portion for circumscribing the filter plug and mixing chamber (and optionally a mouthpiece or secondary filter) includes a combiner wrap, and a tipping paper over the combiner wrap for attaching the filter assembly to the tobacco body. One or both of the combiner wrap or tipping paper are non-porous. The filter plug is composed of cellulose acetate, and the mixing chamber is aerated by perforating or piercing holes through the tipping paper and combiner wrap. The perforations are formed by laser or mechanical means either during the making of the product, or afterwards in a separate operation. The perforations through the wraps covering the mixing chamber ensures that the smoke mainstream and the diluting air stream are allowed to commingle freely after filtration has occurred and prior to the mixture entering the smoker's mouth.

For a better understanding of the invention, reference is made to the following detailed description of the preferred embodiments, taken in conjunction with the drawings accompanying the application.

DETAILED DESCRIPTION OF THE PREFERRED EMBODIMENTS

Figure 1:
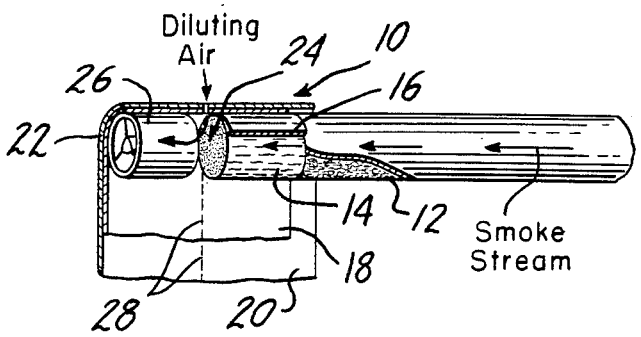
FIG. 1 is a perspective view of a cigarette filter in accordance with the invention, in which the filter assembly is shown with the wrapping partially open.

FIG. 1 illustrates a ventilation-type cigarette filter assembly 10 in accordance with the invention together with an elongated body of tobacco 12. The filter assembly 10 includes a filter mass or plug 14, which may be a cellulose acetate element or any other appropriate filter material. Filter plugs are normally manufactured with a filter plug wrapper 16 as shown, and for purposes of the following description any reference to a filter plug or filter mass will mean the filter plug and its wrapper, if it has one.

The filter plug 14 is arranged in end-to-end relation to the tobacco body 12, and is circumscribed by a pair of wrapper elements: a non-porous combiner wrap 18 and a non-porous tipping paper 20. The combined wrap 18 and filter plug 14 are attached to the tobacco cylinder by the tipping paper 20 which circumscribes the filter plug 14, the combiner wrap 18, and the end portion of the tobacco wrapper.

The filter plug 14 is spaced from the distal end 22 of the filter assembly 10, to define a section directly adjacent thereto which forms an open mixing chamber 24. An extruded plastic mouthpiece 26 is situated between the mixing chamber 24 and the distal end 22 of the filter assembly. The plastic mouthpiece may, for example, have the construction shown and described in U.S. Pat. No. 3,396,733. The mouthpiece 26 is a plastic tube having a plurality of radially and longitudinally extending ribs. The mouthpiece 26 reinforces the cigarette tip, but permits the unimpeded longitudinal flow of smoke and air from the mixing chamber 24 to the distal end 22.

A plurality of perforations 28 are formed through the combiner wrap 18 and tipping paper 20 so as to communicate between the mixing chamber 24 and outside air. The perforating is conducted during the making of the cigarette by a laser or by a mechanical perforator, which pierces one or more holes into the mixing chamber 24 so that the diluting air enters, as illustrated by the arrow, the chamber 24. The number and sizes of the perforations are selected so that the overall resistance to the flow of incoming air into the mixing chamber 24, relative to the flow resistance, produced by the filter element 14, of the smoke entering the chamber 24, results in the desired ratio of air-to-smoke and the desired draw.

Figure 2:
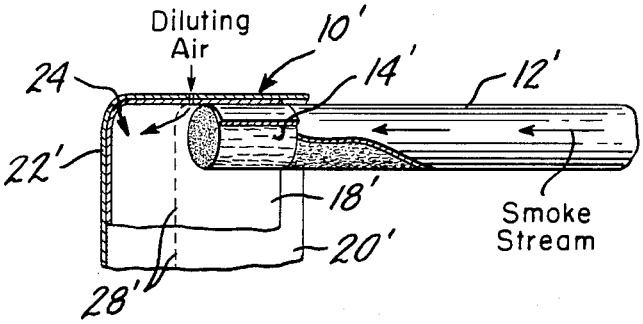
FIG. 2 is a perspective view, similar to that of FIG. 1, of a second embodiment of the invention.

FIG. 2 shows a modified embodiment of the improved cigarette filter of FIG. 1. A cellulose acetate filter plug 14' is circumscribed by a heavy basis weight combiner wrap 18', and a tipping paper 20' in turn surrounds the combiner wrap 18' to attach the filter assembly 10' to the tobacco cylinder 12'. The filter plug 14' is spaced from the distal end 22' of the filter assembly 10' so as to define an open mixing chamber 24' which extends between the filter plug 14' and the distal end 22'. A plurality of holes or perforations 28' are formed through the wrappers 18' and 20' to communicate the mixing chamber 24' with outside air.

Figure 3:
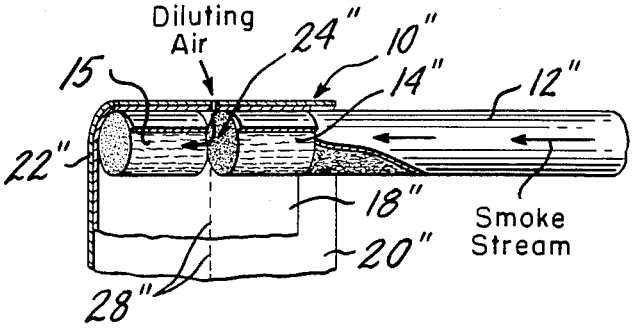
FIG. 3 is a perspective view, similar to that of FIG. 1, of a third embodiment of a cigarette filter in accordance with the invention.

FIG. 3 illustrates a triple section filter assembly 10'' which includes the main filter plug 14'', as well as a secondary filter 15. The filter elements 14'' and 15 may be of acetate material, and are axially spaced to define the open mixing chamber 24'' therebetween. The filters 14'' and 15 and chamber 24'' are circumscribed by a combiner wrap 18'' and tipping paper 20''. The laser or mechanical perforations 28'' are located so that the dilution air enter the mixing chamber 24'' between the filter elements 14'' and 15.

When the filter assembly shown in FIG. 3 is utilized in a cigaratte product, in order to obtain the desired effect, it is mandatory that the majority of the filtration (in the range of about 80–90% or more) occurs in the main filter plug 14''. Accordingly, the main filter element 14'' is made with a small denier per filament tow material and a large total denier, and the final pressure drop (flow resistance) must be relatively high. The exact reverse is true for filter 15, that is, a filter element is utilized with extremely low pressure drop and therefore minimal filtration.

In organoleptic evaluations, cigarettes having filter constructions in accordance with the invention were judged to have significantly enhanced taste characteristics. In order to substantiate the organoleptic evaluations, the nicotine-to-"tar" ratio (nicotine/tar $\times$ 10) and the transference efficiency of menthol were determined and compared to conventional cigarettes. Nicotine and menthol bracket the voltality zone of cigarette smoke which contains the majority of the flavor components of smoke ("semivolatile fraction"). An increase in the values of the nicotine-to-"tar" ratio and menthol transfer efficiency indicates that a large amount of the particulate matter is composed of the most flavorful smoke components.

Filter cigarettes constructed in accordance with the invention were found to have a nicotine-to-tar ratio of 1.5 and a menthol transfer efficiency value of 1.7. A typical cigarette at a comparable particulate matter level generally has a nicotine-to-tar ratio of approximately 1.0 and a menthol transfer efficiency of about 1.3. Although the difference is not large in absolute terms, the percentage difference is quite significant, and this fact is reflected in the judgment of significant taste enhancement in the resulting cigarette product.

If desired, as with other ventilated-type filters, the filter plug may constitute a high density filter mass in order to effect a larger degree of smoke filtration. While the presence of a high density filter produces a draw resistance greater than in normal filter cigarettes, the increased draw through the filter plus is compensated by the introduction of the outside air.

The foregoing represents the preferred embodiments of the invention. Variations and modifications of the embodiments shown and described will be apparent to persons skilled in the art, without departing from the inventive concepts disclosed herein. By way of example, rather than perforating the tipping paper and combiner wrap during or after manufacture of the cigarette, one of the wrapper elements, e.g. the non-porous tipping paper, may be pre-perforated. In such a case, the other wrapper element (the combiner wrap) would be porous. Also, the pattern, number, and spacing of the perforations may be varied, from the example in the drawings, as desired. All such modifications and variations are intended to be within the scope of the invention as defined in the following claims.

We claim:

1. A filter assembly for a smoking article comprising a filter mass and a wrapper means for attaching said filter assembly to a smoking article such that said filter mass is in end-to-end relation thereto, wherein said wrapper means includes an at least substantially non-porous wrapper surrounding and directly engaging said filter mass, wherein said filter assembly has a distal end and said wrapper means retains said filter mass at a fixed position spaced from said distal end, wherein said filter assembly has an open mixing chamber between said filter mass and said distal end, wherein said wrapper means has at least one perforation arranged to communicate between said chamber and outside air and sized for admitting a pre-selected ratio of diluting air to mix with mainstream smoke when smoke is drawn into said chamber through said filter mass, and comprising a secondary filter disposed in said wrapper and arranged between said open mixing chamber and said distal end, wherein said mixing chamber extends between said filter mass and said secondary filter and said secondary filter has a flow resistance value substantially lower than the flow resistance value of said filter mass such that smoke and diluted air are passed substantially unimpeded from said mixing chamber to said distal end.

2. A filter assembly as defined in claim 1, wherein said filter mass and said secondary filter are constructed such that at least 80% of the filtration occurs in said filter mass.

3. A filter assembly as defined in claim 1, wherein said at least one perforation comprises a plurality of perforations spaced about the periphery of said wrapper means.

4. A filter assembly as defined in claim 1, wherein said wrapper defines said open mixing chamber.

5. A filter assembly for a smoking article comprising a filter mass and a wrapper means for attaching said filter assembly to a smoking article such that said filter means is in end-to-end relation thereto, wherein said wrapper means includes an at least substantially non-porous wrapper surrounding and directly engaging said filter mass, wherein said filter assembly has a distal end and said wrapper means retains said filter mass at a fixed position spaced from said distal end, wherein said filter assembly has an open mixing chamber between said filter mass and said distal end, wherein said wrapper means has at least one perforation arranged to communicate between said chamber and outside air and sized for admitting a pre-selected ratio of diluting air to mix with mainstream smoke when smoke is drawn into said chamber through said filter mass, and wherein said filter assembly further comprises a mouthpiece means disposed within said wrapper means, extending from said mixing chamber to said distal end, said mouthpiece means having a substantially open cross-section, formed by at least one longitudinal channel, for passing smoke and diluting air substantially unimpeded from said mixing chamber to said distal end.

6. A filter assembly as defined in claim 5, wherein said wrapper defines said open mixing chamber, and said mouthpiece means comprises a tubular mouthpiece.

7. A filter assembly for a smoking article comprising a filter mass and a wrapper means for attaching said filter assembly to a smoking article such that said filter mass is in end-to-end relation thereto, wherein said wrapper means includes an at least substantially non-porous wrapper surrounding and directly engaging said filter mass, wherein said filter assembly has a distal end and said wrapper means retains said filter mass at a fixed position spaced from said distal end, wherein said filter assembly has a mixing chamber with a uniform, open cross-section that extends from said filter mass to said distal end, wherein said wrapper means has at least one perforation arranged to communicate between said chamber and outside air and sized for admitting a pre-selected ratio of diluting air to mix with mainstream smoke when smoke is drawn into said chamber through said filter mass, whereby said filter assembly is arranged to pass smoke and diluting air substantially unimpeded from said chamber to said distal end.

8. A filter assembly as defined in claim 7, wherein said wrapper defines said open mixing chamber.

* * * * *

UNITED STATES PATENT AND TRADEMARK OFFICE

CERTIFICATE OF CORRECTION

PATENT NO. : 4,564,030

DATED : Jan. 14, 1986

INVENTOR(S) : Terry D. Jessup and Albert B. Hudson

It is certified that error appears in the above-identified patent and that said Letters Patent is hereby corrected as shown below:

Column 5, line 11, "plus" shoud read "plug";

Column 6, line 3, after "claim 1," insert --5 or 7--;

Column 6, line 11, "means" should read --mass-.

Signed and Sealed this

First Day of July 1986

[SEAL]

Attest:

DONALD J. QUIGG

Attesting Officer

Commissioner of Patents and Trademarks